United States Patent [19]

Davis

[11] Patent Number: 4,498,212

[45] Date of Patent: Feb. 12, 1985

[54] FLUE CLEANER

[76] Inventor: John D. Davis, P.O. Box 55, Black Mountain, N.C. 28711

[21] Appl. No.: 528,408

[22] Filed: Sep. 1, 1983

[51] Int. Cl.[3] ..... F23J 3/02

[52] U.S. Cl. ..... 15/242; 15/104.16; 15/104.3 R

[58] Field of Search ..... 15/242, 243, 249, 162, 15/163, 104.05, 104.16, 104.18, 104.19, 104.2, 104.3 R, 93 R

[56] References Cited

U.S. PATENT DOCUMENTS 312,206 2/1885 Jenks ..... 15/104.3 R
1,042,841 10/1912 Thorsen ..... 15/104.16
1,672,757 6/1928 Gabrielse ..... 15/104.16

FOREIGN PATENT DOCUMENTS 50488 7/1919 Sweden ..... 15/104.16

*Primary Examiner*—Edward L. Roberts
*Attorney, Agent, or Firm*—David M. Carter

[57] ABSTRACT

An improved flue cleaner is provided having a scraper and an adjustable fulcrum assembly mounted on opposite sides of the end portion of an elongated rod. The fulcrum assembly includes a roller rotatably mounted on one end of a pivotable beam and is fixed in place by a bracket which is connected to the beam and to the rod in an adjustable fashion.

9 Claims, 3 Drawing Figures

FLUE CLEANER

BACKGROUND OF THE INVENTION

This invention relates to chimney flue cleaners. More particularly, it relates to an improved chimney flue cleaner which is adjustable for various sizes of flues.

In recent years, since the energy crisis began, there has been a widespread return to woodburning stoves for home heating. Unlike woodburning stoves of the distant past, which burned vigorously and hot allowing the unburned particles to escape up the flue as gas, the modern stove is relatively air-tight for controlled combustion. This feature allows greater fuel conservation and a more even heat output. However, this energy conservation feature has a hazardous side effect. Because of the lower temperatures in controlled combustion, a higher percentage of the unburned combustable materials in the wood smoke is deposited on the walls of the flue. This deposited material called creosote is highly combustable. Over time the deposits continue to build. Two results of this buildup are obvious and both dangerous. First, the buildup of creosote will in time reduce the size of the flue passageway so that the amount of smoke leaving the combustion chamber of the stove has an increasingly smaller space through which to travel to the outside. This results in yet poorer combustion and the backup of more smoke in the stove. Whenever the stove door is opened smoke in ever larger quantities is emitted into the room causing possible smoke damage to the interior of the house and polluting the air. If this situation is not corrected the flue can become completely blocked and the stove rendered useless.

Second, and much more importantly, the buildup of the creosote in the flue produces an ever increasing quantity of highly combustable material outside of the combustion chamber of the stove. When the proper conditions are present, the creosote may ignite and the results are often disastrous, as many stories in the news media testify.

There are two procedures for preventing a flue and/or house fire caused by creosote buildup. The first is to reduce to a minimum the buildup of the creosote deposits by the use of expensive catalytic burners. These devices enable most of the creosote producing materials to be consumed before reaching the flue. However, many people cannot afford the new stoves with the catalytic feature or the expense of adding the device to an already expensive "air tight" stove.

The second procedure is to periodically eliminate the creosote buildup by physically stripping it from the flue walls and removing it.

In recent years several techniques have been devised for the physical removal of flue creosote. One method uses wire brushes on a shaft which is inserted down the chimney. By moving the brushes up and down the buildup is supposed to be removed. The effectiveness of this method is minimal, however, since creosote is a sticky tar-like substance which mere brushing cannot remove.

Another widely used method, and equally ineffective, is lowering a jute bag filled with rocks, bricks, chains, etc. into the flue and pulling it out again. Needless to say, this will not remove the sticky creosote.

More recently a device has come on the market which is lowered down the flue on a rope, then a spring loaded series of wire hooks are caused to push out against the inside walls of the flue. As the device is pulled up to the top of the flue the wire hooks render a clawing action which should remove the tar where the hooks engage it. This is probably the most efficient method of removing creosote heretofore known. However, there are several important limitations to this device. First, it is expensive. Second, it cannot strip all of the creosote from the flue walls—only where the wire hooks engage the surface—leaving ridges of creosote still clinging to the flue. Third, this device will fit only the shape of flue for which it is expressly made. For example, one made for a rectangular flue will only work in a rectangular flue, a round device for a round flue, and a square device for a square flue. If a home owner has more than one flue shape he will have to purchase more than one device in order to keep his flues cleaned out. Fourth, there is the possibility that the spring loaded hooks can become snagged at a joint of two flue liner sections, making it difficult to pull the device back up and possibly damaging the flue liner by causing it to crack or chip. Other prior art is shown in patent literature.

German Patent No. 100,926 shows a flue cleaner including a rod having a wheel mounted thereto. The working end of the cleaner includes a somewhat complicated spring actuated device which causes a pair of scrapers to project at a 90° angle from the rod and resting against opposing sides of the flue.

U.S. Pat. No. 4,319,378 shows a chimney cleaner utilizing a plate which is bent at a 90° angle having a plurality of fingers extending therefrom. A pair of adjustable rollers are mounted at an angle with respect to each other and are connected to the plate.

U.S. Pat. No. 1,230,310 shows a chimney cleaner which utilizes a flat scraping blade connected to a rod with a compression element extending from the rod to compress the scraping blade against one side of the flue.

U.S. Pat. No. 580,258 shows a flue cleaner having a pair of scrapers extending at opposing narrow angles from the end of an elongated rod with the angle being adjusted by a spacing bolt.

In a non-analogous art U.S. Pat. No. 935,259 shows a floor scraper which utilizes a roller connected to a rod which further includes a scraper connected to the axle of the roller.

In view of the current state of the art and the problems associated with increased usage of wood stoves, there exists a need for a simple and inexpensive but effective flue cleaner.

OBJECTS OF THE INVENTION

It is therefore one object of this invention to provide an improved flue cleaner.

It is another object to provide a flue cleaner which is effective in removing stubborn creosote but also inexpensive and easy to use.

It is another object to provide a flue cleaner which is readily adjustable for various sizes of flues.

It is still another object to provide a flue cleaner which is universal in the sense that it may be used on both round and rectangular flues with simple adjustments.

SUMMARY OF THE INVENTION

In accordance with one form of this invention there is provided an improved flue cleaner having an elongated rod with a free end and a handle end. A scraper is connected to one side of the rod near the free end. A fulcrum assembly is connected to the opposite side of the rod, also near the free end. The fulcrum assembly includes a roller extending away from the rod. The roller is located substantially nearer to the handle end of the rod than the scraper. The scraper contacts one side of the flue and the roller contacts the other side. The roller acts as a fulcrum to pivot the scraper by the back and forth action of the handle end of the rod by the user of the flue cleaner.

DESCRIPTION OF THE PREFERRED EMBODIMENT

Figure 1:
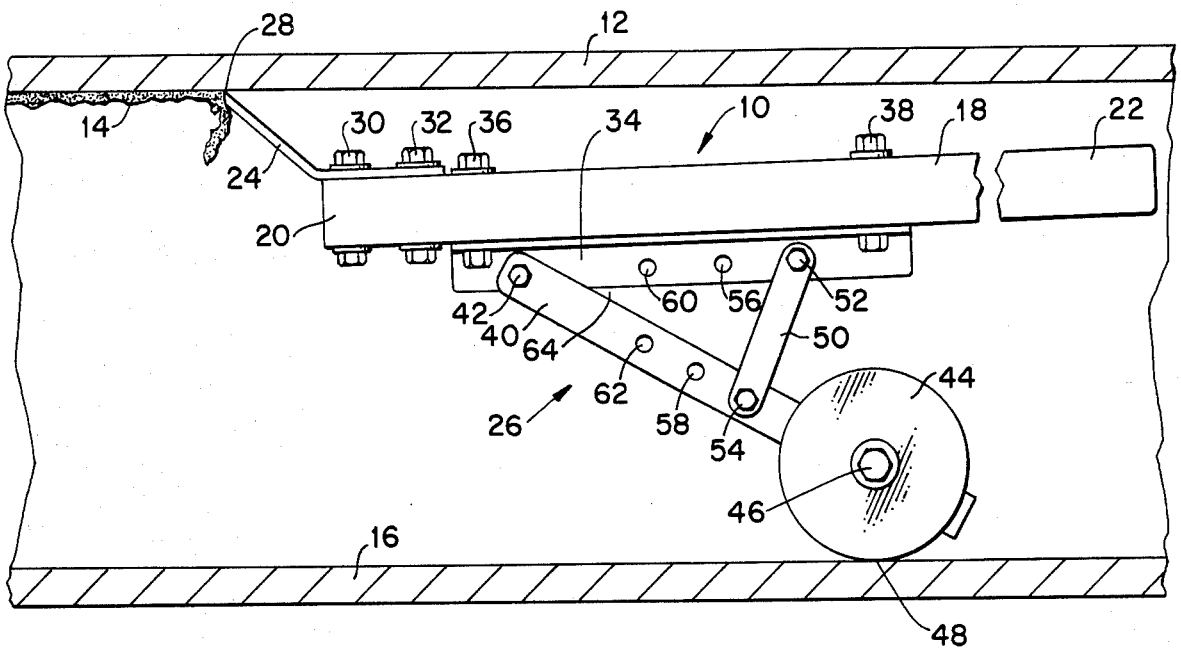
FIG. 1 is a side elevational view of the improved flue cleaner of the subject invention operating in a flue which is shown in cross-section.

Referring now more particularly to FIG. 1, there is provided improved flue cleaner 10 which is shown operating in chimney flue 12 which is caked with creosote 14 on the wall 16 of the flue. The flue cleaner includes elongated rod 18 having free end 20 and handle end 22. The handle end 22 protrudes from the end of the flue and is gripped by the person who is operating the cleaner. Normally the person will be standing on the roof of a house next to the flue. Scraper 24 and fulcrum assembly 26 are mounted on opposite sides near the free end 20 of rod 18. The scraper 24 is bent at an angle greater than 0° from the longitudinal axis of the rod 18. The scraper includes sharpened end 28 for making contact with and removing the creosote 14 and other deposits in the flue. The scraper is bolted to the rod 18 by means of bolts 30 and 32. Fulcrum assembly 36 is mounted somewhat nearer the handle end 22 than the scraper. The fulcrum assembly includes a first angle iron bracket 34 which is bolted to rod 18 by bolts 36 and 38. A second angle iron bracket 40 is swivelably connected to the first angle iron 34 by bolt 42. The other end of the second angle iron has a pair of rollers 44 connected thereto. The pair of rollers may be better seen in reference to FIG. 2, which is a top view of the flue cleaner.

Figure 2:
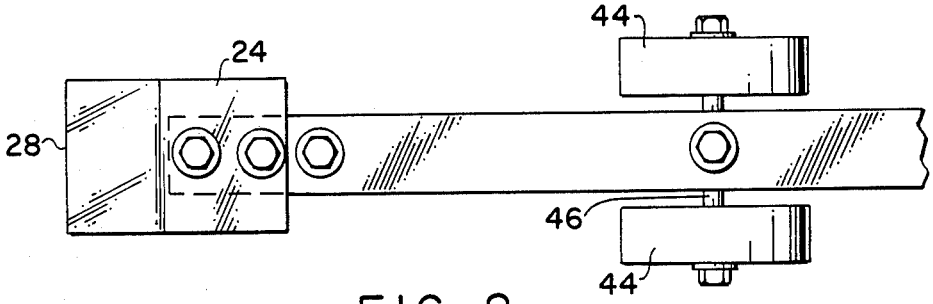
FIG. 2 is a top view of the flue cleaner of FIG. 1.
Figure 3:
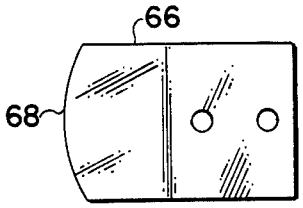
FIG. 3 is a top view of a scraper attachment which is an alternative to the one shown in FIG. 2.

In this embodiment the rollers are in the form of wheels which are mounted on axle 46 which extends through second angle iron bracket 40. The outer or rolling surface 48 of roller 44 makes contact with the opposite surface of the flue from the side of the flue contacted by the sharpened end 28 of the scraper. As can be seen, roller 44 is located between the handle end 22 of the rod and the scraper tip 28 but closer to the scraper. The fulcrum assembly 26 is made adjustable by means of bracket 50 which rigidly connects angle iron bracket 34 to angle iron bracket 40. The adjustability is due to the fact that bracket 50 may be mounted at varying positions along the length of the two angle irons. The bracket 50 may be mounted in hole pairs 52 and 54, 56 and 58 or 60 and 62. Mounting is accomplished by bolts. Alternatively, for very narrow flues the bracket 50 may be eliminated and angle iron bracket 34 may be bolted directly to angle iron bracket 40 by placing a bolt through holes 52 and 54. As can be seen, the angle 64 is increased or decreased depending upon the placement of bracket 50 across the two angle irons. The scraper 24 which is shown in FIG. 2 includes a linear sharpened end 28. The linear type of scraper is particularly adapted for rectangular flues. An alternative scraper which is shown in FIG. 3 as scraper 66 includes a curved sharpened scraper end 68 which is particularly adapted for cylindrical flues. Rod 18 is preferably made of pine and its length is determined by the height of the flue to the bottom of the thimble plus two feet. Scraper 24 is preferably made of steel and bent 25° at its midpoint. Brackets 34, 40 and 50 are normally made of steel or iron. Brackets 34 and 40 are L-shaped with a plurality of holes along each flat surface. Wheels 44 may be made of wood.

In operating the improved flue cleaner the fulcrum assembly is first adjusted by mounting bracket 50 at its appropriate position along angle iron brackets 34 and 40 depending upon the size of the flue to be cleaned. The free end of the rod is then inserted into the open end of the flue above the roof. The wheels 44 are placed against one side of the flue and the handle is positioned so that the chisel point 28 presses firmly against the other side of the flue. The operator thrusts the device downward for 10 to 12 inches, maintaining pressure of the chisel on the side being cleaned. The pressure is relaxed and the device is lifted to the starting point moving slightly to one side and then another downward thrust is made until that section of the flue is cleaned. The device is then lowered below the cleaned area and the sequence begins again and continues until the creosote is removed. Thus it can be seen that an improved, inexpensive, and efficient flue cleaner has been developed. A single device can be used on both round flues and rectangular flues, ranging from very small diameters such as 5 inches to the larger diameter such as 16 inches. The device enables the operator to usefully apply greater force in thrusting downward to cut away the creosote than by pulling upwardly as with some other devices. Furthermore, in the event that a part of the device becomes damaged or broken it can be easily repaired or replaced because of its simple construction.

From the foregoing description of the preferred embodiment of the invention it will be apparent that many modifications may be made therein without departing from the true spirit and scope of the invention.

I claim:

1. An improved flue cleaner comprising: an elongated rod having a free end and a handle end, a scraper connected to one side of said rod near said free end, a fulcrum assembly connected to the opposite side of said rod near said free end, said fulcrum assembly including a roller extending away from said rod, said roller being located between said handle end of said rod and said scraper but closer to said scraper, said scraper adapted to contact one side of the flue, said roller adapted to contact the other side of the flue whereby said roller acts as a fulcrum to pivot said scraper by back and forth action of the handle end of said rod; said roller being rotatably mounted to one end of a first bracket; the other end of said first bracket being pivotably connected to said rod; a second bracket connected to said first bracket; a third bracket mounted along the surface of said opposite side of said rod, said second bracket being connected to said third bracket to rigidly hold said roller away from said rod; the distance between said roller and said rod is variable for various sizes of flues; means for mounting said second bracket at various points along said first bracket and said third bracket.

2. A device as set forth in claim 1, wherein said scraper has a cutting end extending away from said rod.

3. A device as set forth in claim 2, wherein the cutting end edge of said scraper is at an angle greater than 0° from the longitudinal axis of said rod.

4. A device as set forth in claim 1, wherein said roller is at least one wheel.

5. A device as set forth in claim 1, where the cutting edge of said scraper is linear for use in rectangular flues.

6. A device as set forth in claim 1, wherein the cutting edge of said scraper is curved for use in cylindrical flues.

7. A device as set forth in claim 1, wherein said scraper is removably attached to said rod.

8. A device as set forth in claim 1, wherein said scraper is mounted only on one side of said rod and said roller is mounted only on the opposite side of said rod from said scraper.

9. An improved flue cleaner comprising:

an elongated rod having a free end and a handle end, a scraper connected to one side of said rod near said free end, said scraper including a cutting end, said scraper being bent so that the said cutting end extends from said rod wherein the said bent portion of said scraper forms an angle greater than 0° with respect to the longitudinal axis of said rod, a fulcrum assembly connected to the opposite side of said rod near said free end, said fulcrum assembly including first, second and third brackets and at least one wheel, said first bracket being mounted to said opposite side of said rod, said second bracket being swivelably connected to said first bracket, said wheel being rotatably connected to said second bracket, said third bracket connected between said first and said second brackets wherein said wheel extends away from said rod, said wheel being located substantially nearer to said handle end of said rod than said scraper, said first and said second brackets each including a plurality of mounting positions for said third bracket wherein said fulcrum assembly is made adjustable, said scraper adapted to contact one side of said flue and said wheel adapted to contact the other side of said flue wherein said wheel acts as a fulcrum to pivot said scraper by back and forth action of the handle end of said rod.

* * * * *